US007467833B2

(12) United States Patent
Weng

(10) Patent No.: US 7,467,833 B2
(45) Date of Patent: Dec. 23, 2008

(54) ASSEMBLED/LINKED LOCKING APPARATUS

(76) Inventor: Kuo-Chan Weng, No. 196-6, Hsin Chuang Ling, Tukie Chen, Yun Lin Hsien (TW)

( * ) Notice: Subject to any disclaimer, the term of this patent is extended or adjusted under 35 U.S.C. 154(b) by 327 days.

(21) Appl. No.: 11/197,374

(22) Filed: Aug. 5, 2005

(65) Prior Publication Data

US 2006/0249643 A1 Nov. 9, 2006

Related U.S. Application Data

(63) Continuation-in-part of application No. 11/120,968, filed on May 4, 2005, now abandoned.

(51) Int. Cl.
*E05B 65/46* (2006.01)

(52) U.S. Cl. ..... 312/221; 312/333

(58) Field of Classification Search ..... 312/220, 312/221, 333, 334.46
See application file for complete search history.

(56) References Cited

U.S. PATENT DOCUMENTS

| | | | | |
|---|---|---|---|---|
| 5,176,436 | A * | 1/1993 | Mitchell | 312/221 |
| 6,779,855 | B2 * | 8/2004 | Hoffman | 312/219 |
| 6,796,625 | B2 * | 9/2004 | Lauchner et al. | 312/334.46 |
| 6,979,064 | B2 * | 12/2005 | Chiu | 312/221 |
| 7,063,398 | B2 * | 6/2006 | Hoffman | 312/219 |
| 7,293,845 | B2 * | 11/2007 | Hoffman | 312/219 |
| 2003/0141790 | A1 * | 7/2003 | Weng | 312/217 |
| 2004/0036387 | A1 * | 2/2004 | Ludwig et al. | 312/221 |

FOREIGN PATENT DOCUMENTS

| | | | | |
|---|---|---|---|---|
| DE | 3633256 | * | 3/1988 | 312/221 |

* cited by examiner

*Primary Examiner*—Hanh V Tran
(74) *Attorney, Agent, or Firm*—Troxell Law Office, PLLC

(57) ABSTRACT

An assembled/linked locking apparatus including a first and a second slide rail assemblies and a first and a second activators. The first and second slide rail assemblies respectively include a stationary slide rail and a telescopic slide rail set. The first activator is disposed at an end of the telescopic slide rail set. The second activator is corresponding to the first activator and disposed at the stationary slide rail. The second activator includes a base seat, a guide seat, a bar member, a pair of slide ways and a slide member. The base seat is disposed at the stationary slide rail. The guide seat is disposed on the base seat. The two slide ways are oppositely respectively formed on the base seat and the guide seat. Two ends of the slide member are respectively fitted in the slide ways. Two ends of the bar member are respectively passed through the spaces between the base seats and the guide seats of the first and second slide rail assemblies. When the telescopic slide rail set of the second slide rail assembly extends out of the stationary slide rail, the first activator drags the slide member to push and engage with the bar member so as to prevent the telescopic slide rail set of the first slide rail assembly from extending out of the stationary slide rail.

15 Claims, 13 Drawing Sheets

ASSEMBLED/LINKED LOCKING APPARATUS

This application is a continuation-in-part of application Ser. No. 11/120,968, entitled ASSEMBLED/LINKED LOCKING APPARATUS, filed on May 4, 2005 now abandoned.

BACKGROUND OF THE INVENTION

The present invention is related to a locking apparatus, and more particularly to an assembled/linked locking apparatus of a tool cabinet or file cabinet having several drawers.

A drawer and a cabinet are equipped with corresponding rails. The rails are slidably fitted with each other for easily pushing or drawing the drawer within the cabinet. The rails are provided with stoppers such as projecting blocks or projecting plates to prevent the drawer from detaching from the cabinet and dropping.

The drawer is often designed with a considerable length for receiving more articles. In order to fully draw the drawer out of the cabinet without being derailed and immediately push the drawer into the cabinet after taking articles, three rails are provided, including a cabinet slide rail, a middle slide rail and a drawer slide rail. Each slide rail has stop blocks on predetermined portions of one end or two ends of the slide rail. The slide rails are slidably assembled with each other and the stop blocks stop each other, whereby the drawer can be fully drawn out of the cabinet without derailing and dropping. Ball bearings are provided between the slide rails to reduce frictional force therebetween and noise.

The tool cabinet or file cabinet includes several drawers arranged from upper side to lower side. After the drawers contain tools or files, the drawers will have considerable weight. In the case that the drawers are drawn too hard or in the case of earthquake or collision by external force, the tool cabinet or file cabinet will be tilted to make some drawers slip out. Under such circumstance, the gravity center of the cabinet will change and the cabinet may fall down.

In order to avoid tilting down of the cabinet when drawing out too many drawers, a slide rail locking structure has been developed by which only one drawer can be drawn at one time. Substantially, a linking unit is disposed at one end of each slide rail assembly. Once the drawer slide rail of one slide rail assembly is pulled, the linking unit is activated to drive a link disposed between the respective slide rail assemblies to stop the drawer slide rails of other slider rail assemblies from being pulled. For example, in U.S. Pat. No. 5,352,030, a disc-like activating block is disposed at rear end of the drawer slide rail. In U.S. Pat. No. 5,634,701, an activating block having a slope is disposed at front end of one side of the drawer. In U.S. Pat. No. 5,988,778, an activating block is disposed at front end of the drawer slide rail.

In U.S. Pat. No. 5,352,030, a hook body is disposed at rear end of the drawer slide rail for hooking and pulling the disc-like activating block. This is strength-consuming and the components are likely to be worn. Therefore, the using life of the product is shortened.

SUMMARY OF THE INVENTION

It is therefore a primary object of the present invention to provide an assembled/linked locking apparatus which can prolong the using life of the product without affecting the mobility of the drawers.

It is a further object of the present invention to provide the above assembled/linked locking apparatus which can be mounted in a narrow space of the slide rail assembly to more truly achieve the locking effect. When one of the drawers is drawn out, the other drawers are prevented from being drawn out.

According to the above objects, the assembled/linked locking apparatus of the present invention includes a first and a second slide rail assemblies and a first and a second activators. The first and second slide rail assemblies respectively include a stationary slide rail and a telescopic slide rail set. The first activator is disposed at the telescopic slide rail set. The second activator is disposed at the stationary slide rail. The second activator includes a base seat, a guide seat, a bar member, a pair of slide ways and a slide member.

The present invention can be best understood through the following description and accompanying drawings wherein:

BRIEF DESCRIPTION OF THE DRAWINGS

FIG. 4B and 5B are views respectively according to FIG. 4A and 5A, showing that a bar member is displaced;

DETAILED DESCRIPTION OF THE PREFERRED EMBODIMENTS

Figure 1:
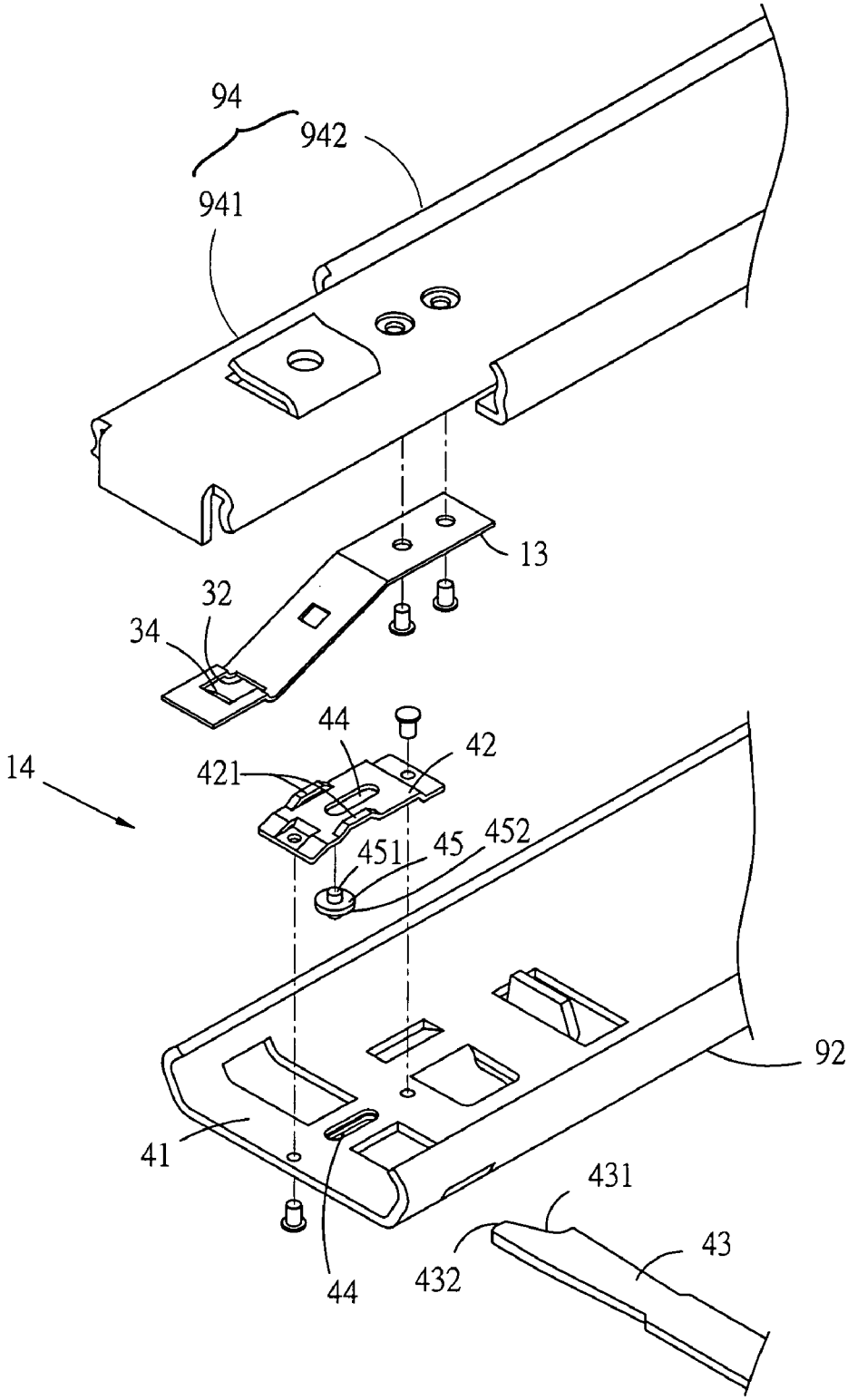
FIG. 1 is a perspective exploded view of for one of slide rail assemblies of a first preferred embodiment of the present invention.
Figure 2A:
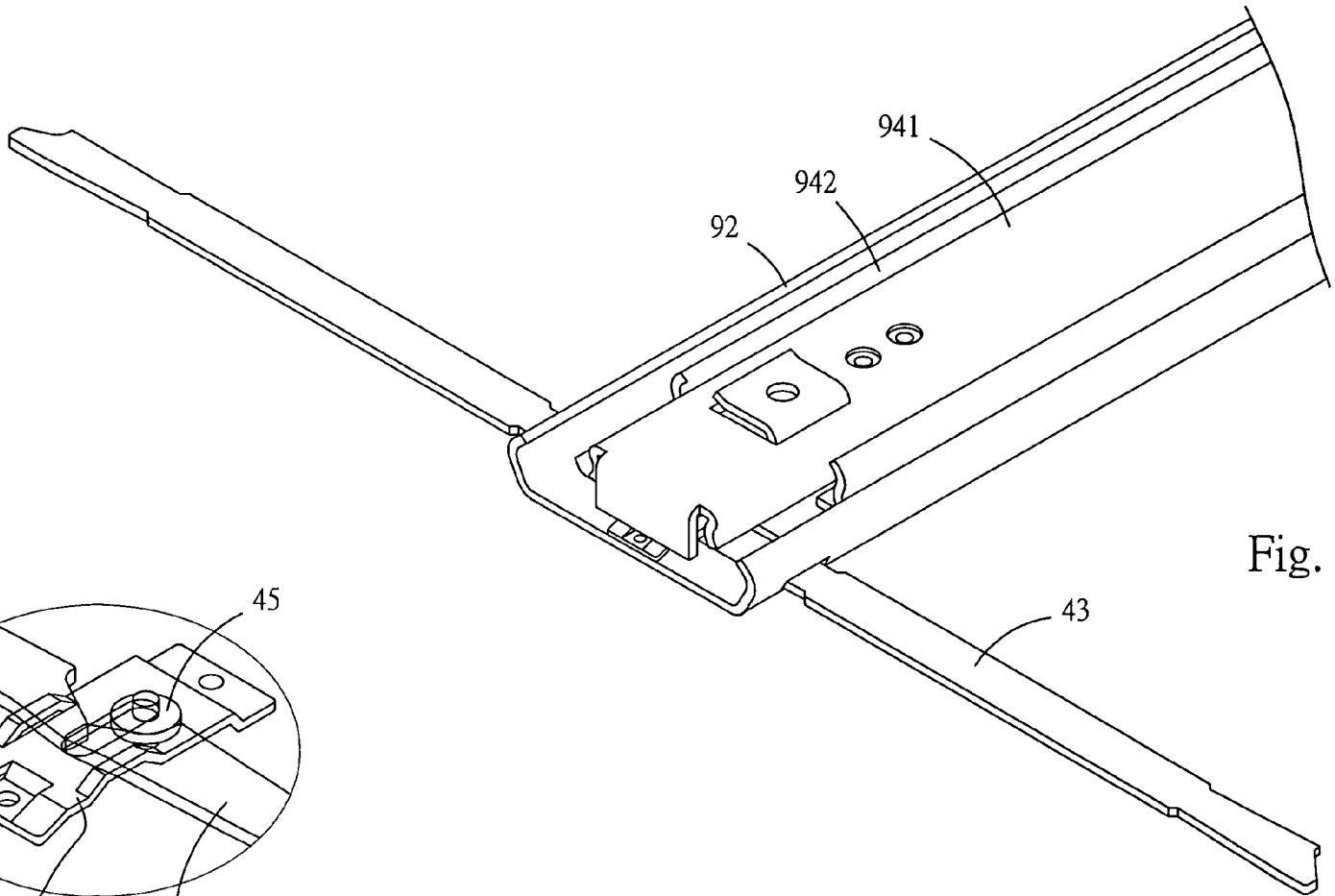
FIG. 2A is a perspective view of the first preferred embodiment of the present invention that a telescopic slide rail set is wholly pushed into a stationary slide rail.
Figure 2B:
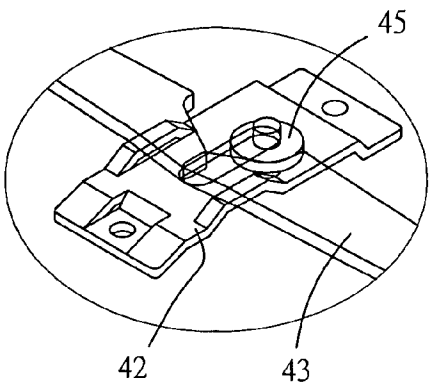
FIG. 2B is a perspective view showing that a slide member of FIG. 2A is in a first position.
Figure 3A:
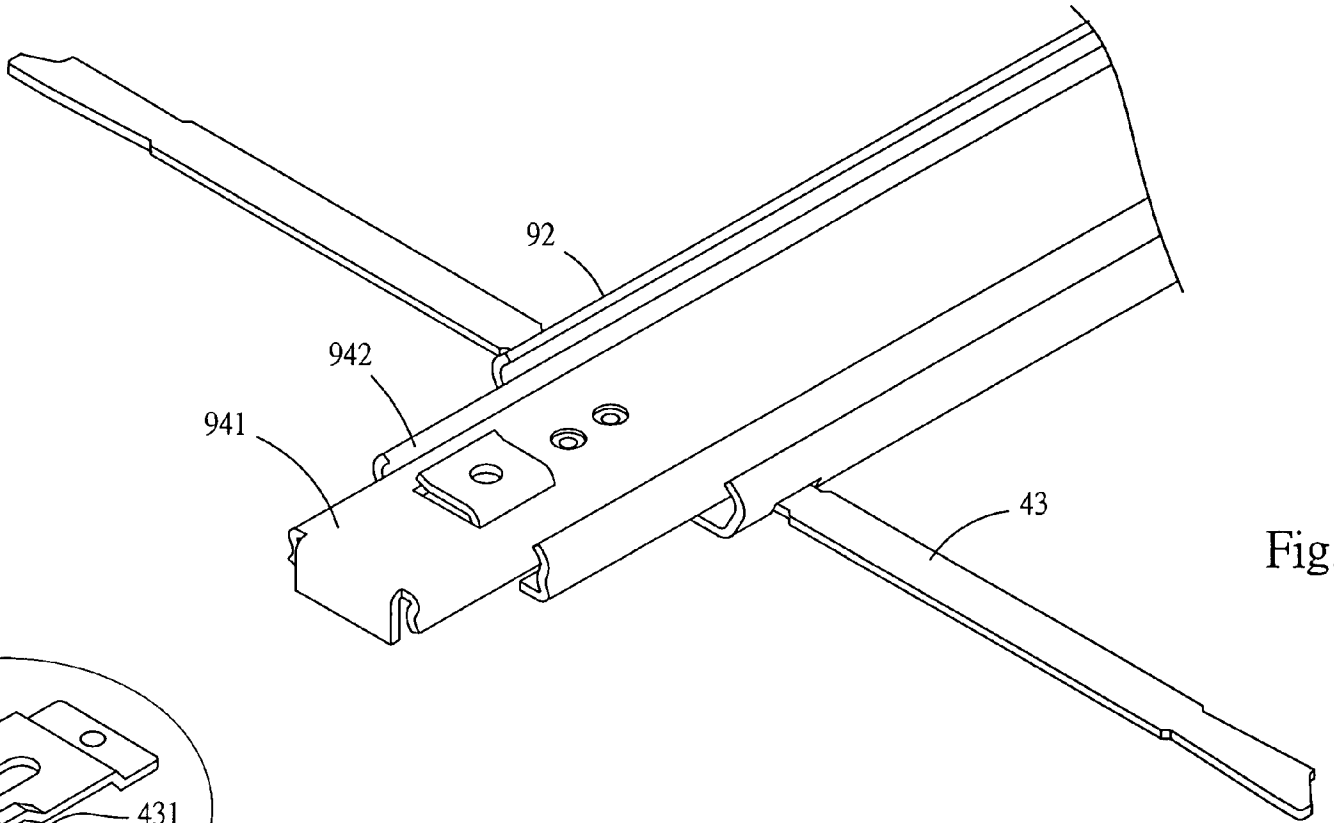
FIG. 3A is a perspective view of the first preferred embodiment of the present invention that the telescopic slide rail set is pulled out the stationary slide rail.
Figure 3B:
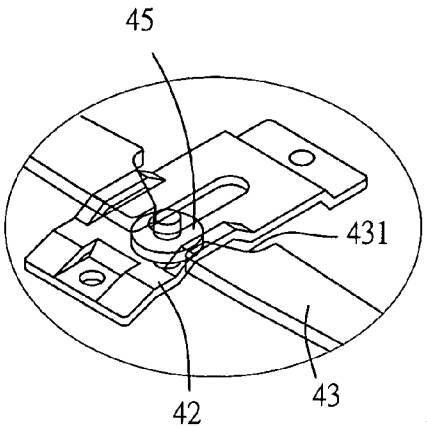
FIG. 3B is a perspective view showing that the slide member of FIG. 3A is in a second position.
Figure 4A:
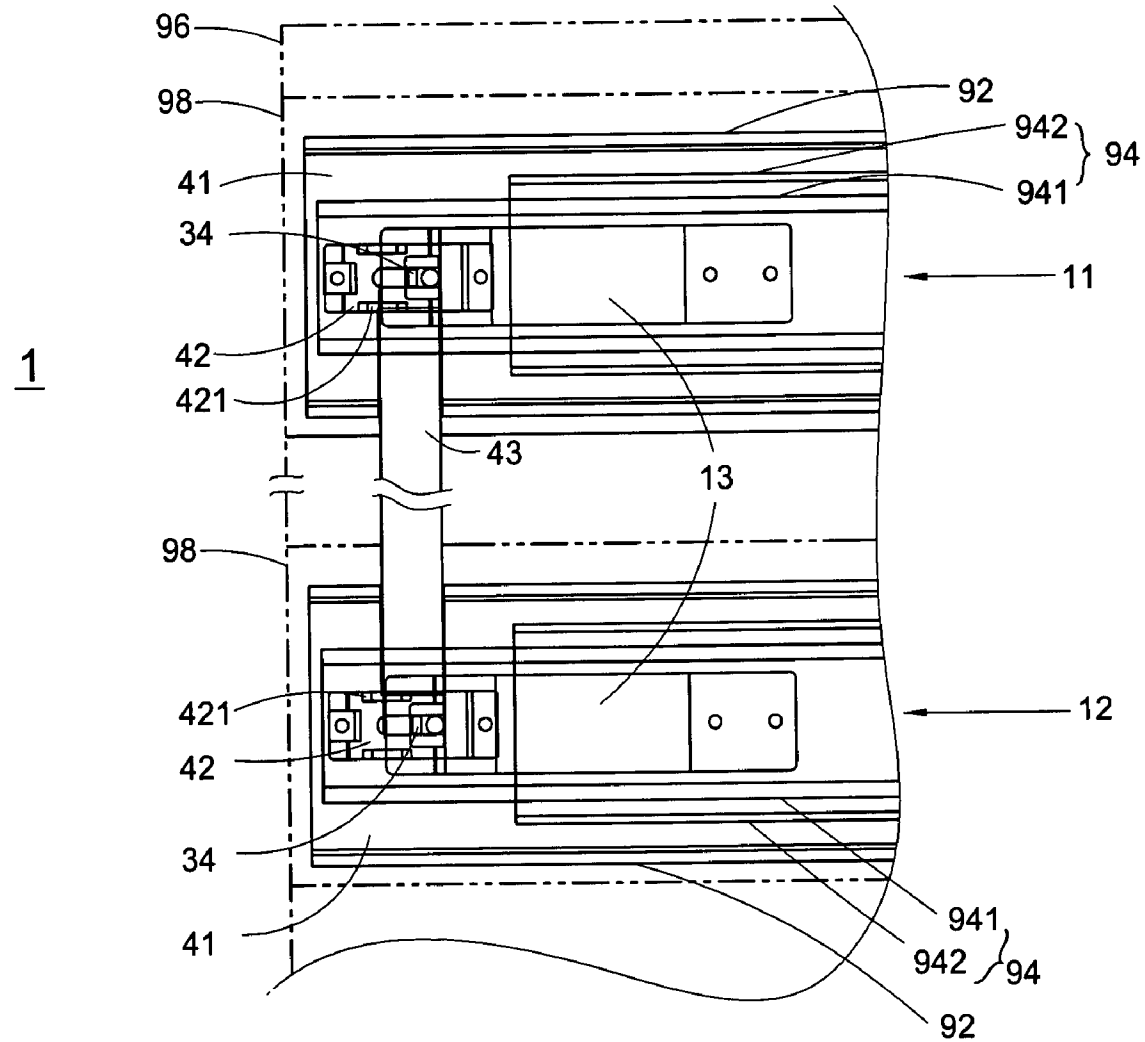
FIG. 4A and 5A show the operation of the first embodiment of the present invention.
Figure 4B:
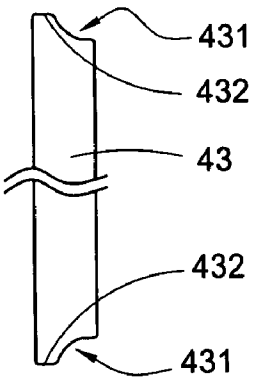
Figure 5A:
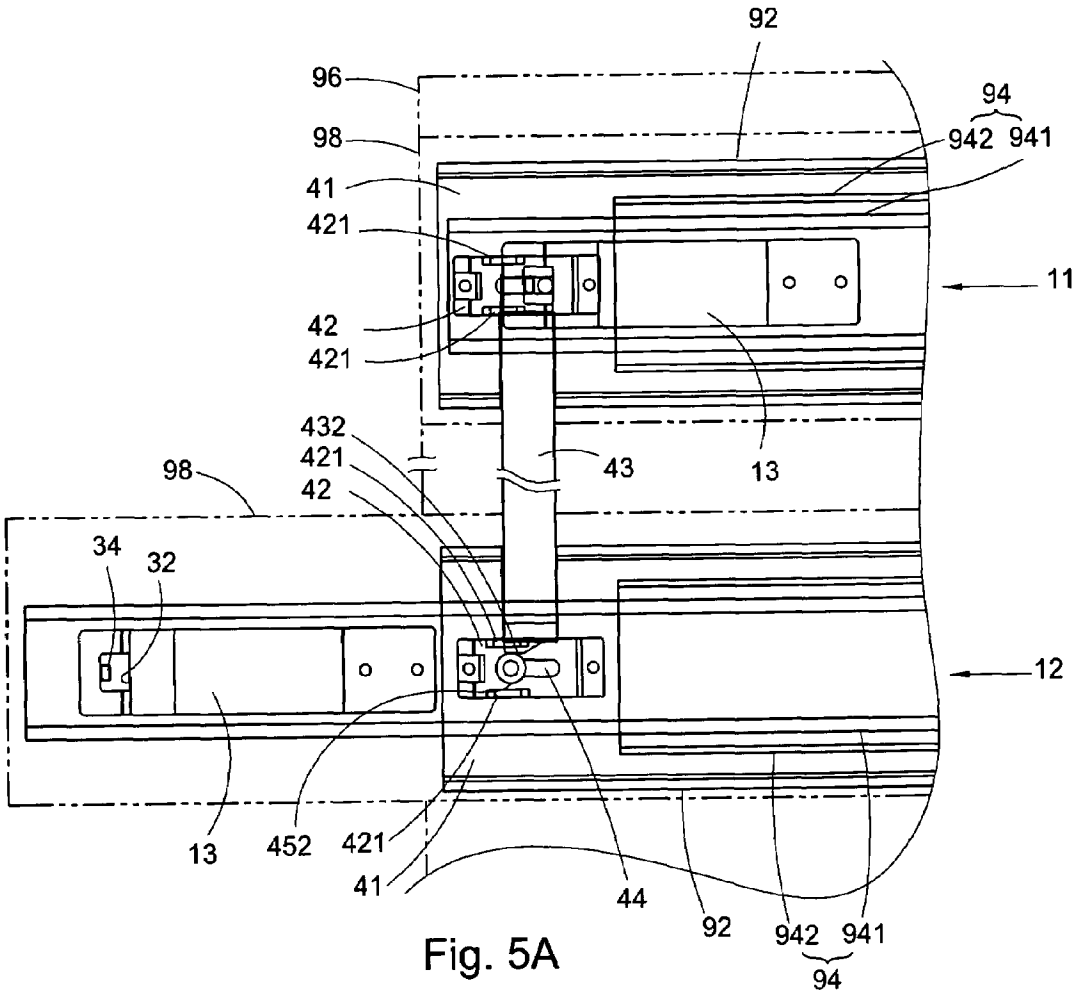

Please refer to FIGS. 1, 2A, 2B, 3A, 3B, 4A, 4B, 5A, 5B, 6A to 6C and 7A to 7C. The assembled/linked locking apparatus 1 of the present invention includes a first slide rail assembly 11, a second slide rail assembly 12, a first activator 13 disposed on the first and second slide rail assemblies 11, 12 and a second activator 14 disposed on the first and second slide rail assemblies 11, 12.

The first slide rail assembly 11 is positioned above the second slide rail assembly 12 corresponding to the second slide rail assembly 12. The first slide rail assembly 11 and the second slide rail assembly 12 respectively include a stationary slide rail 92 and a telescopic slide rail set 94.

The stationary slide rail 92 is a channeled body having a bottom wall and two sidewalls. An outer side of the bottom wall is fixed on inner side of a cabinet body 96 having an internal space. At least two drawers 98 are respectively corresponding to the first and second slide assemblies 11, 12 and vertically arranged in the internal space.

The telescopic slide rail set 94 includes a drawer slide rail 941 and a middle slide rail 942. The drawer slide rail 941 and the middle slide rail 942 are a channeled body having a bottom wall and two sidewalls. An outer side of the bottom wall of the drawer slide rail 941 is fixed on the corresponding drawer 98. The two sidewalls of the drawer slide rail 941 are slidably disposed in the middle slide rail 942. Via the middle slide rail 942, the telescopic slide rail set 94 is slidably disposed in the stationary slide rail 92. The telescopic slide rail set 94 can be extended out of front end of the stationary slide rail 92.

The first activator 13 comprises a first connecting section 32 and a second connecting section 34 and is disposed at an end of the telescopic slide rail set 94. A plate body with a certain length is disposed at an end of the telescopic slide rail set 94 such as front end of the drawer slide rail 941. The other end of the plate is formed with a first connecting section 32 which can be a cross section and a second connecting section 34 which can be a lug.

The second activator 14 is corresponding to the first activator 13 and disposed at the stationary slide rail 92. The second activator 14 includes a base seat 41, a guide seat 42, a bar member 43, a pair of slide ways 44 and a slide member 45.

The base seat 41 is disposed at the stationary slide rail 92.

The guide seat 42 is disposed on the base seat 41 corresponding to the first activator 13. The guide seat 42 has a guide face 421 for guiding the other end of the first activator 13 to swing. The effect of the guide face 421 will be described hereinafter.

The bar member 43 is reciprocally movably disposed between the first and second slide rail assemblies 11, 12. Two ends of the bar member 43 are respectively passed through the spaces between the base seats 41 and the guide seats 42 of the first and second slide rail assemblies 11, 12.

The two slide ways 44 are oppositely respectively formed on the base seat 41 and the guide seat 42. Each slide way 44 is a slot.

The slide member 45 is disposed between the base seats 41 and the guide seats 42 and corresponding to an end of the bar member 43. Two ends of the slide member 45 are respectively fitted through each slide way 44, whereby the slide member 45 can reciprocally move along the slide ways 44 in the sliding direction of the telescopic slide rail set 94. A boss-shaped third connecting section 451 is formed on one face of the slide member 45. The third connecting section 451 is dragged by the first and second connecting sections 32, 34 of the first activator 13, whereby the slide member 45 can be back and forth reciprocally slid between a first position and a second position. The slide member 45 is formed with a fourth connecting 452 corresponding to an end of the bar member 43. The fourth connecting section 452 can be a partially lateral side of the slid member 45. Such as the slide member 45 is a disc or a cylinder, the fourth connecting section 452 is disposed at the partially round lateral side of the disc or the cylinder.

Each end of the bar member 43 is formed with a fifth connecting section 431 corresponding to the fourth connecting section 452. When the slide member 45 is positioned in the first position, the fifth connecting section 431 serves to relatively move to the fourth connecting section 452 and abut against the fourth connecting section 452. The fifth connecting section 431 can be a notched shape.

Each end of the bar member 43 is formed with a sixth connecting section 432 corresponding to the fourth connecting section 452. When the slide member 45 is positioned in the second position, the fourth connecting section 452 abuts against the sixth connecting section 432. The sixth connecting section 432 can be a straight cross section.

According to the above arrangement, when the telescopic slide rail set 94 of the second slide rail assembly 12 is extended from the front end of the stationary slide rail 92, the first connecting section 32 of the first activator 13 drags the third connecting section 451 to make the slide member 45 move from the first position to the second position. Correspondingly, via the fourth connecting section 452, the slide member 45 pushes the bar member 43, whereby the fourth connecting section 452 of the slide member 45 abuts against the sixth connecting section 432 of the bar member 43 to engage with the bar member 43. Therefore, the telescopic slide rail set 94 of the first slide rail assembly 11 is prevented from being extended from the front end of the stationary slide rail 92.

Figure 6A:
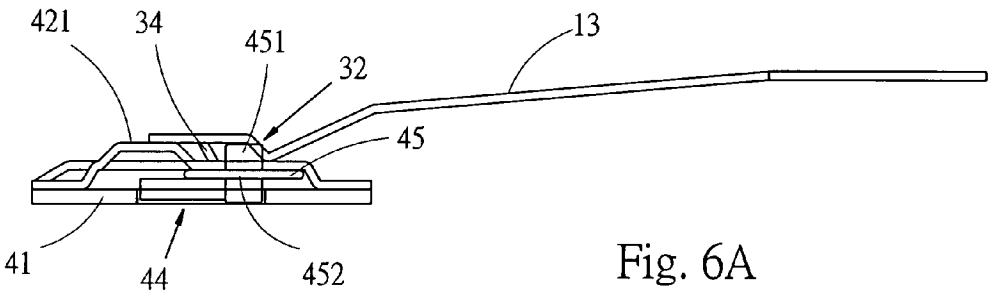
FIG. 6A to 6C are side views of the first embodiment of the present invention showing that when one of the drawers is drawn out, a first activator drags the slide member from the first position to the second position.
Figure 6B:
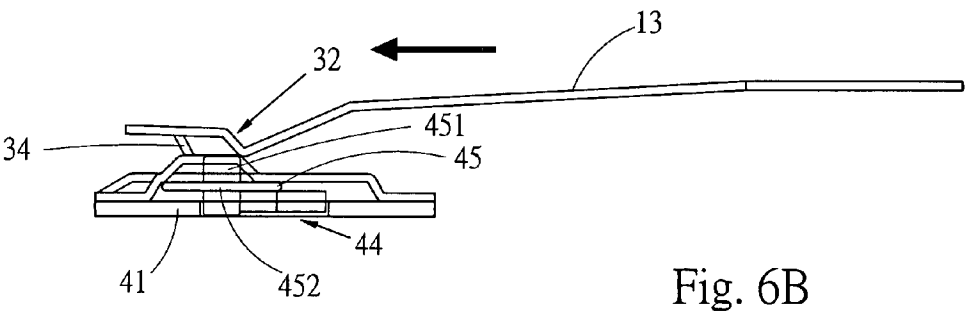
Figure 6C:
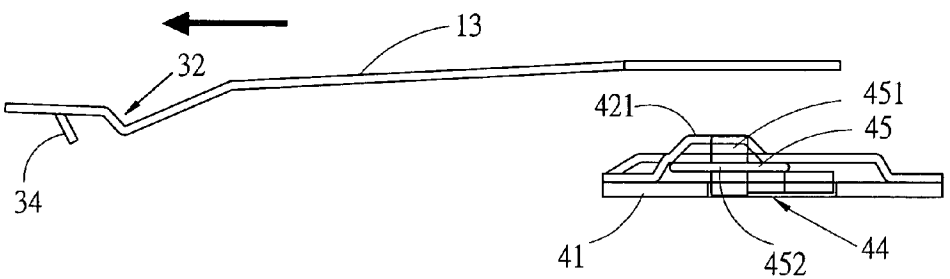
Figures 7A, 7B, 7C:
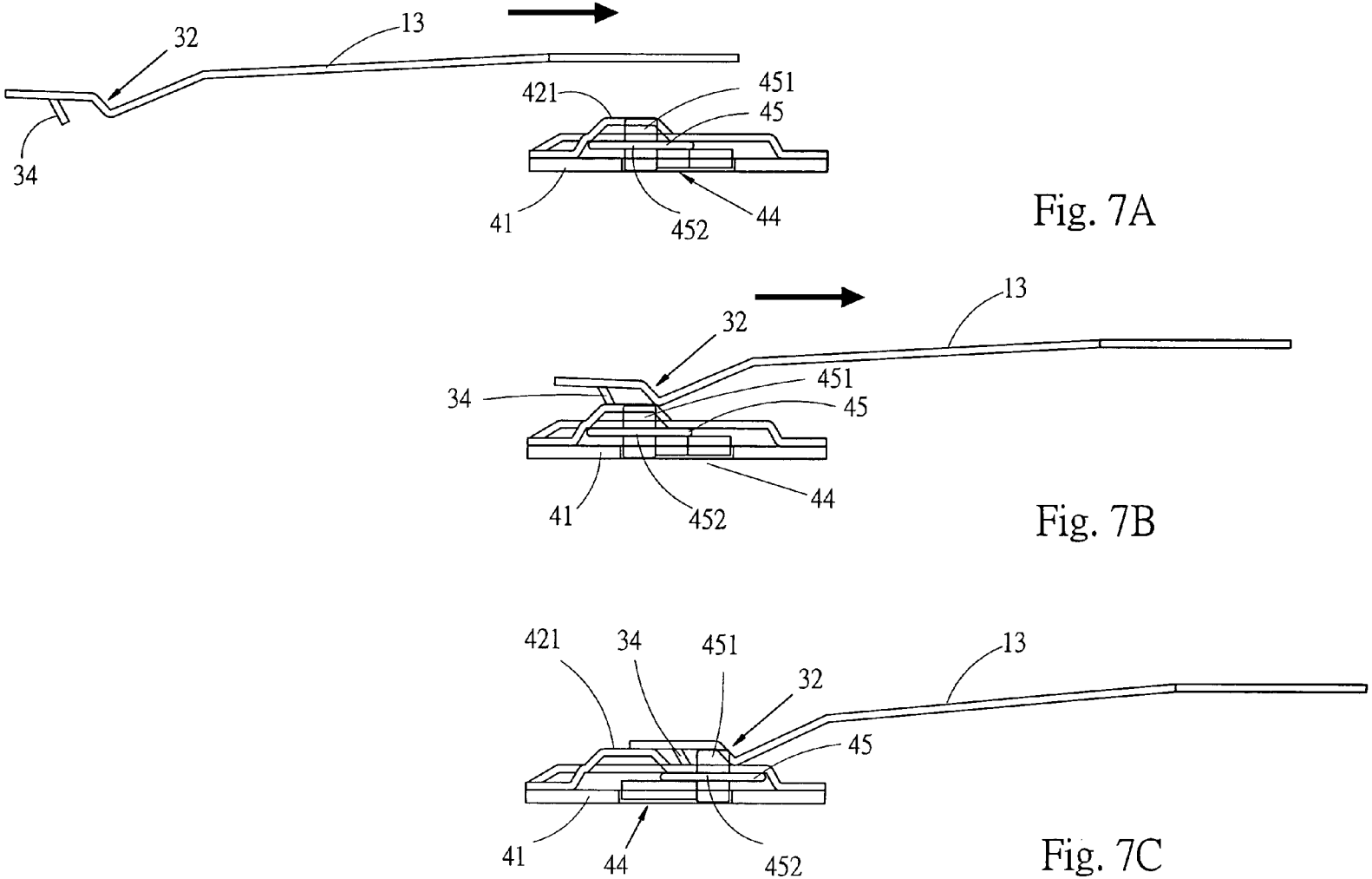
FIG. 7A to 7C are side views of the first embodiment of the present invention showing that when the drawer is pushed in, the first activator drags the slide member from the second position to the first position.
Figure 8:
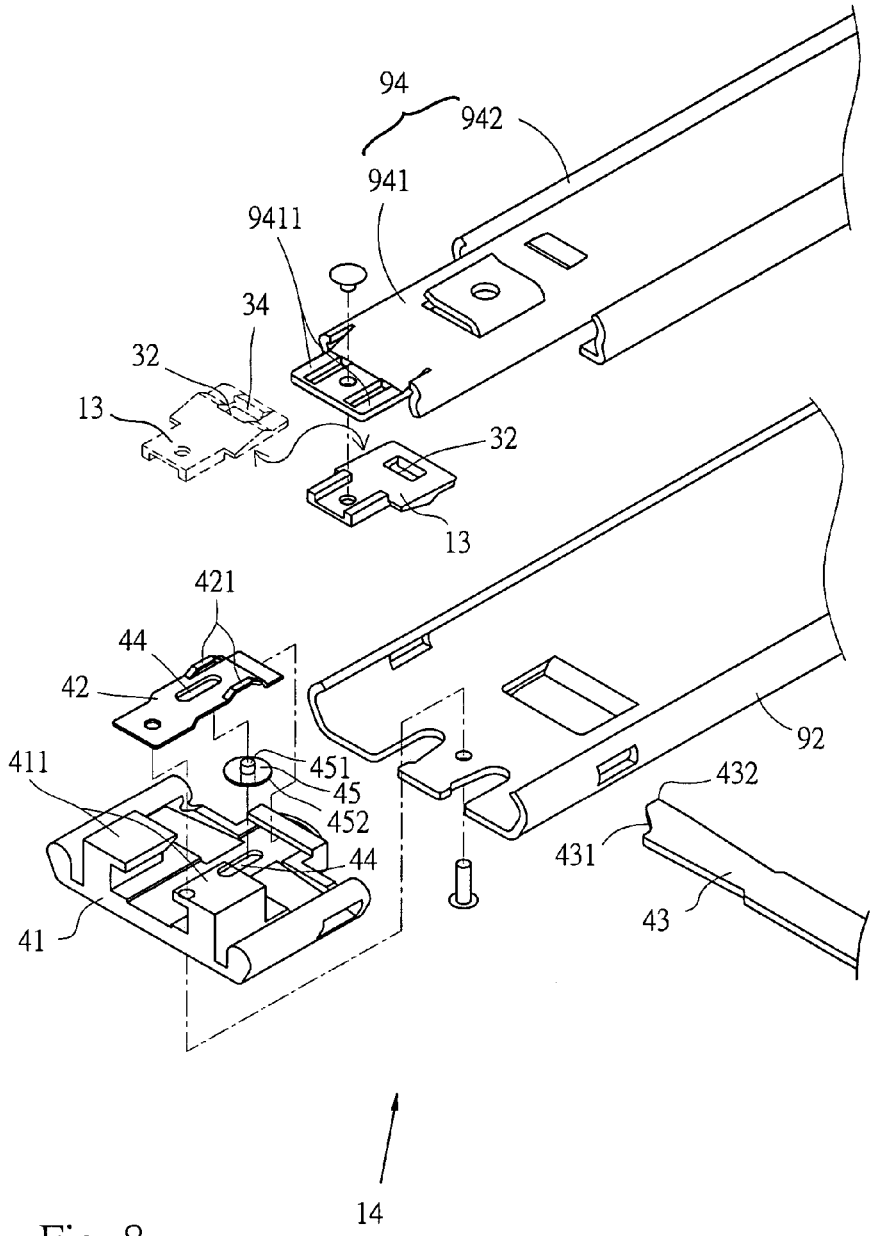
FIG. 8 is a perspective exploded view for one of slide rail assemblies of a second preferred embodiment of the present invention.
Figure 9A:
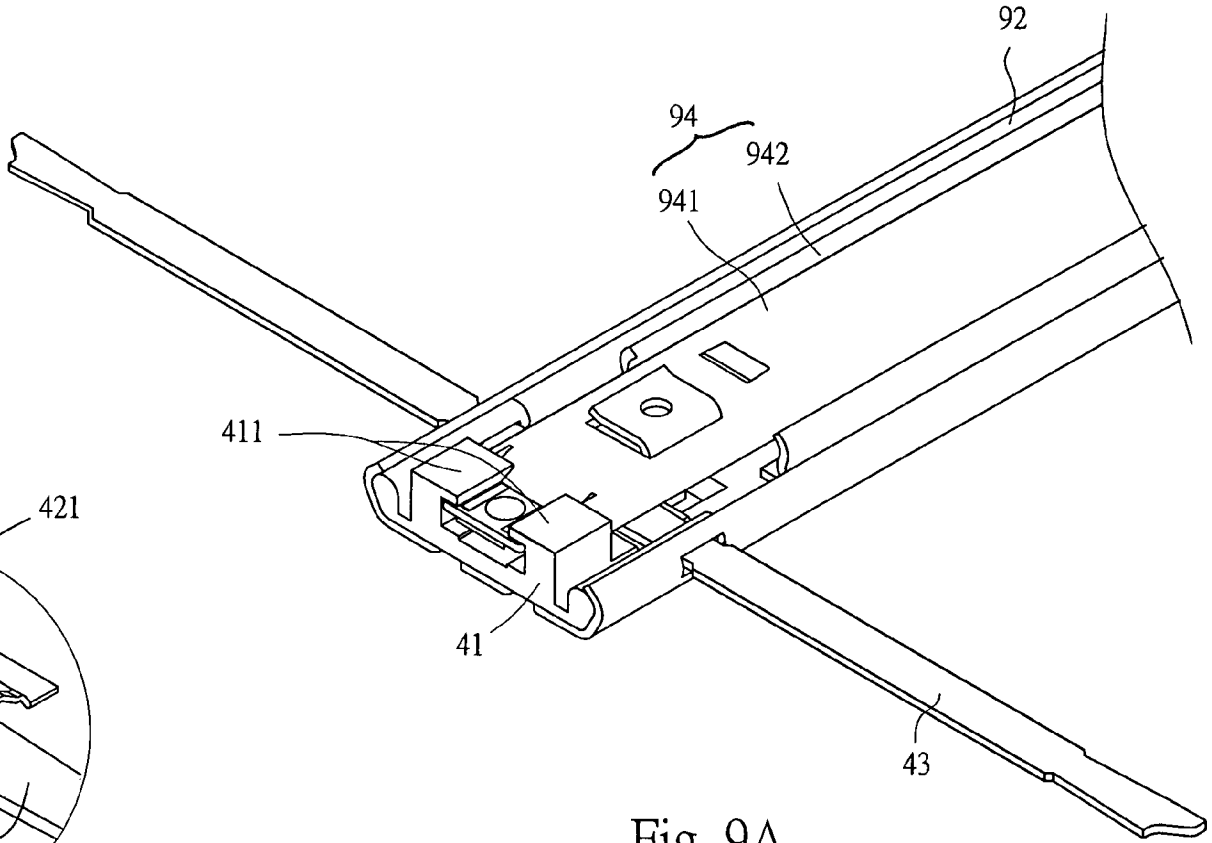
FIG. 9A is a perspective view of the second preferred embodiment of the present invention that a telescopic slide rail set is wholly pushed into a stationary slide rail.
Figure 9B:
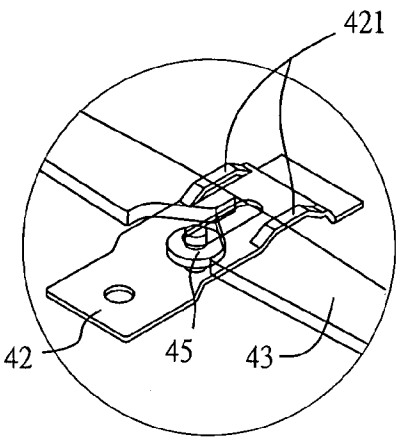
FIG. 9B is a perspective view showing that a slide member of FIG. 9A is in a first position.
Figure 10A:
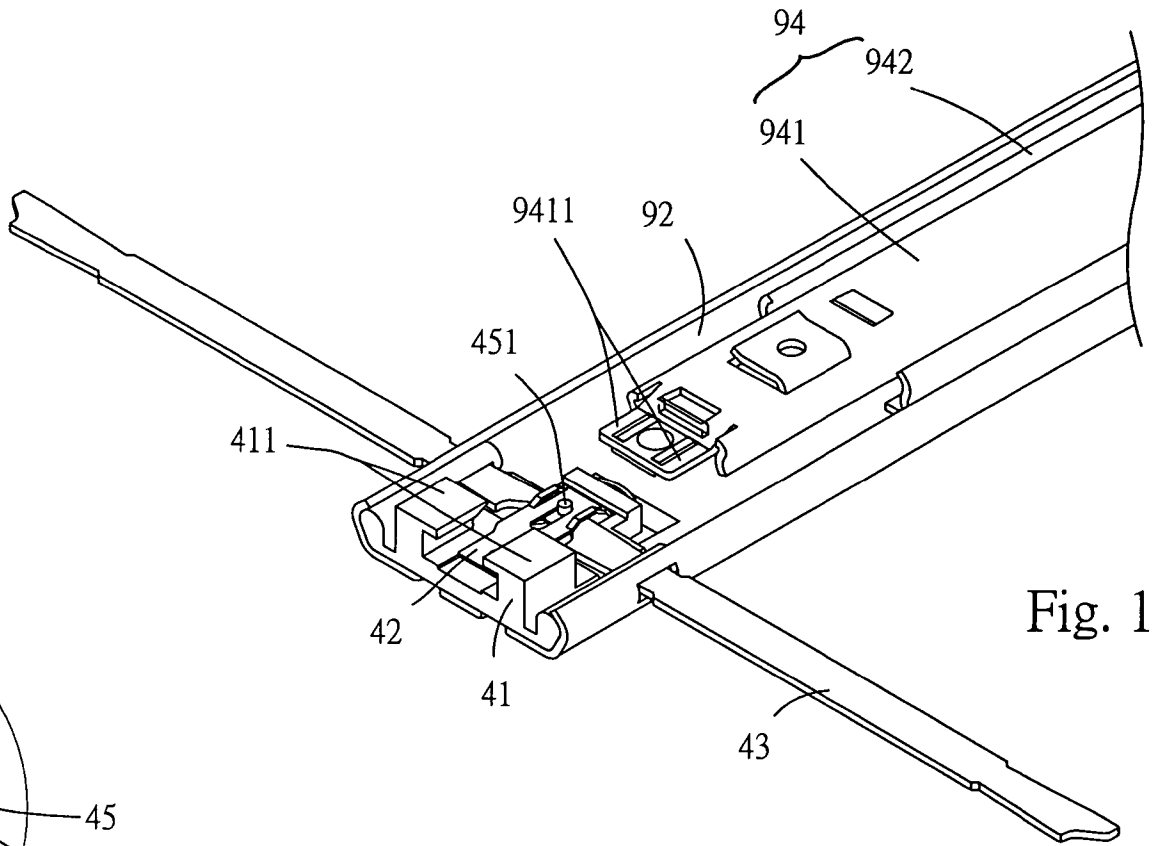
FIG. 10A is a perspective view of the second preferred embodiment of the present invention that the telescopic slide rail set is pulled out the stationary slide rail.
Figure 10B:
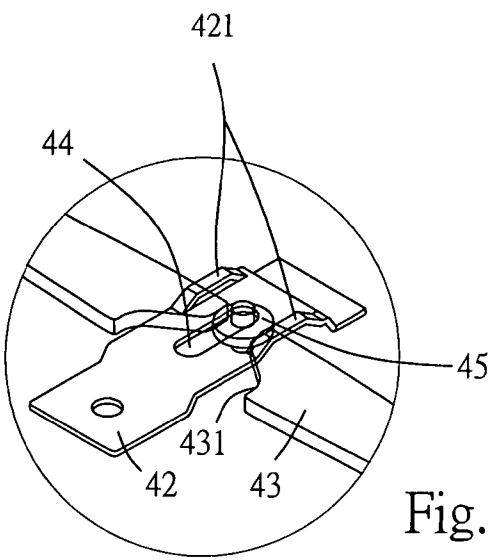
FIG. 10B is a perspective view showing that the slide member of FIG. 10A is in a second position.
Figure 11:
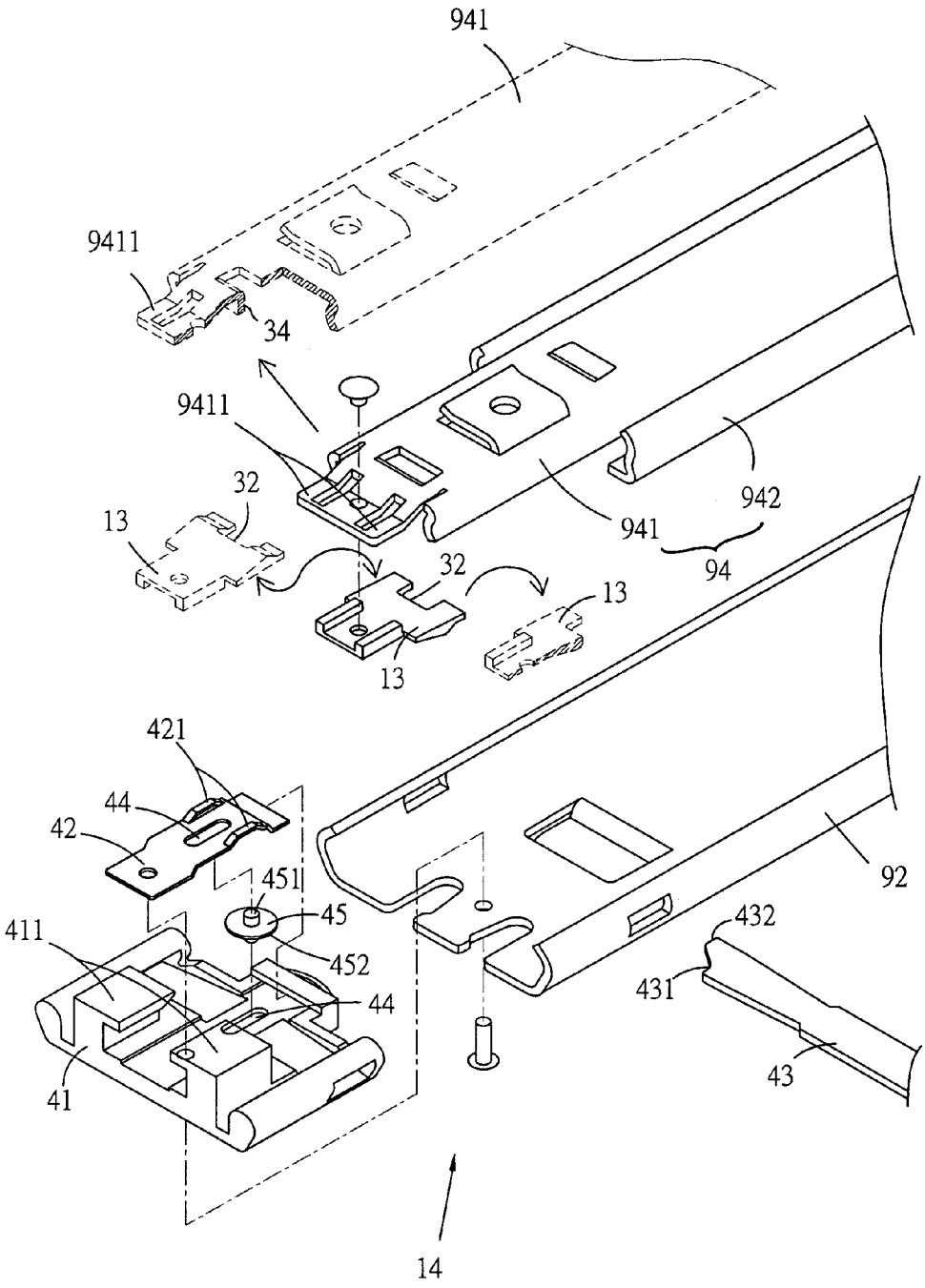
FIG. 11 is a perspective exploded view for one of slide rail assemblies of a third preferred embodiment of the present invention.
Figures 12A, 12B, 12C:
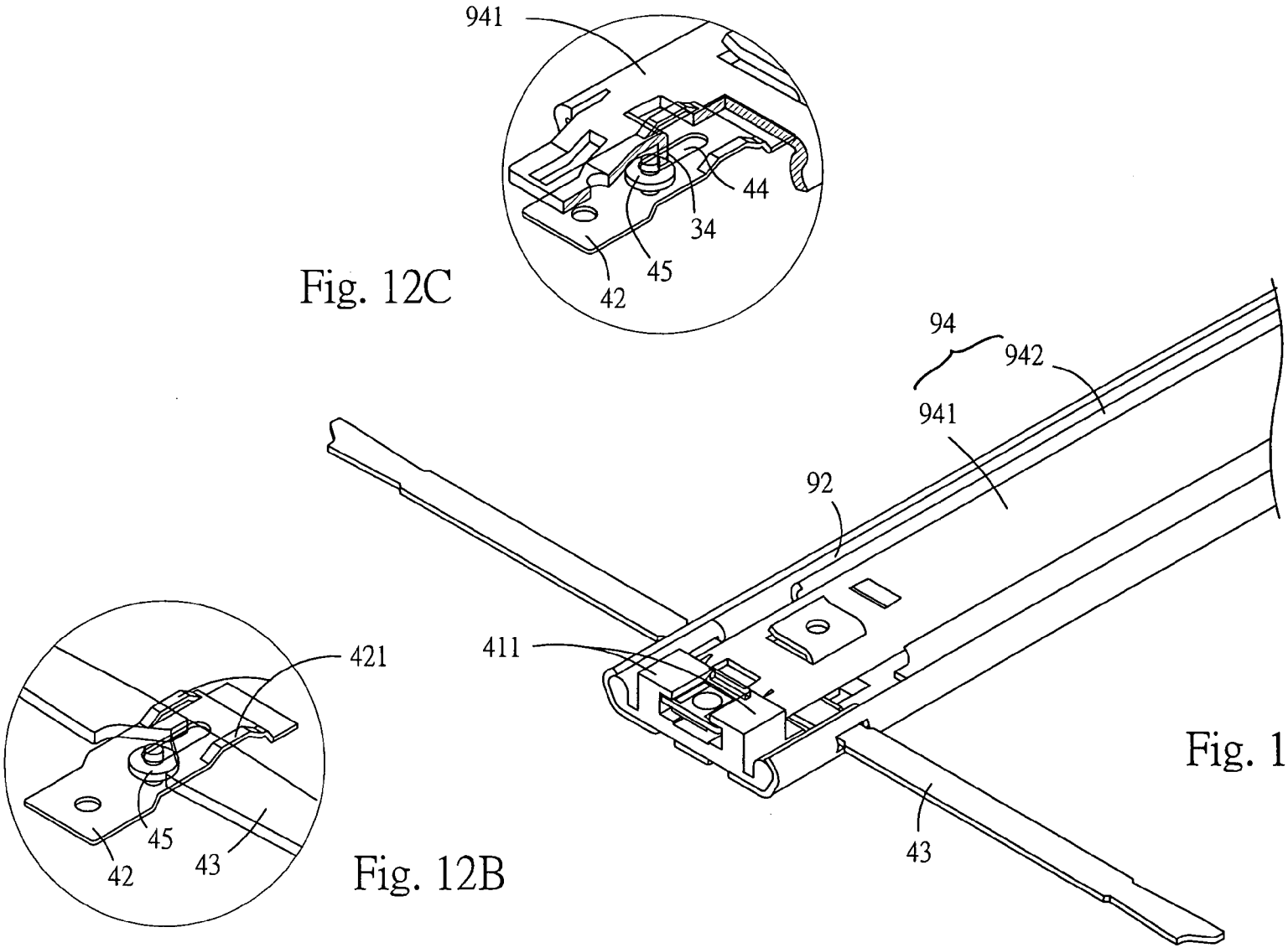
FIG. 12A is a perspective view of the third preferred embodiment of the present invention that a telescopic slide rail set is wholly pushed into a stationary slide rail.
FIG. 12B is a perspective view showing that a slide member of FIG. 12A is in a first position.
FIG. 12C is a partial cutaway and perspective view showing that the slide member of FIG. 12A is corresponding to a second connecting section.
Figures 13A, 13B, 13C:
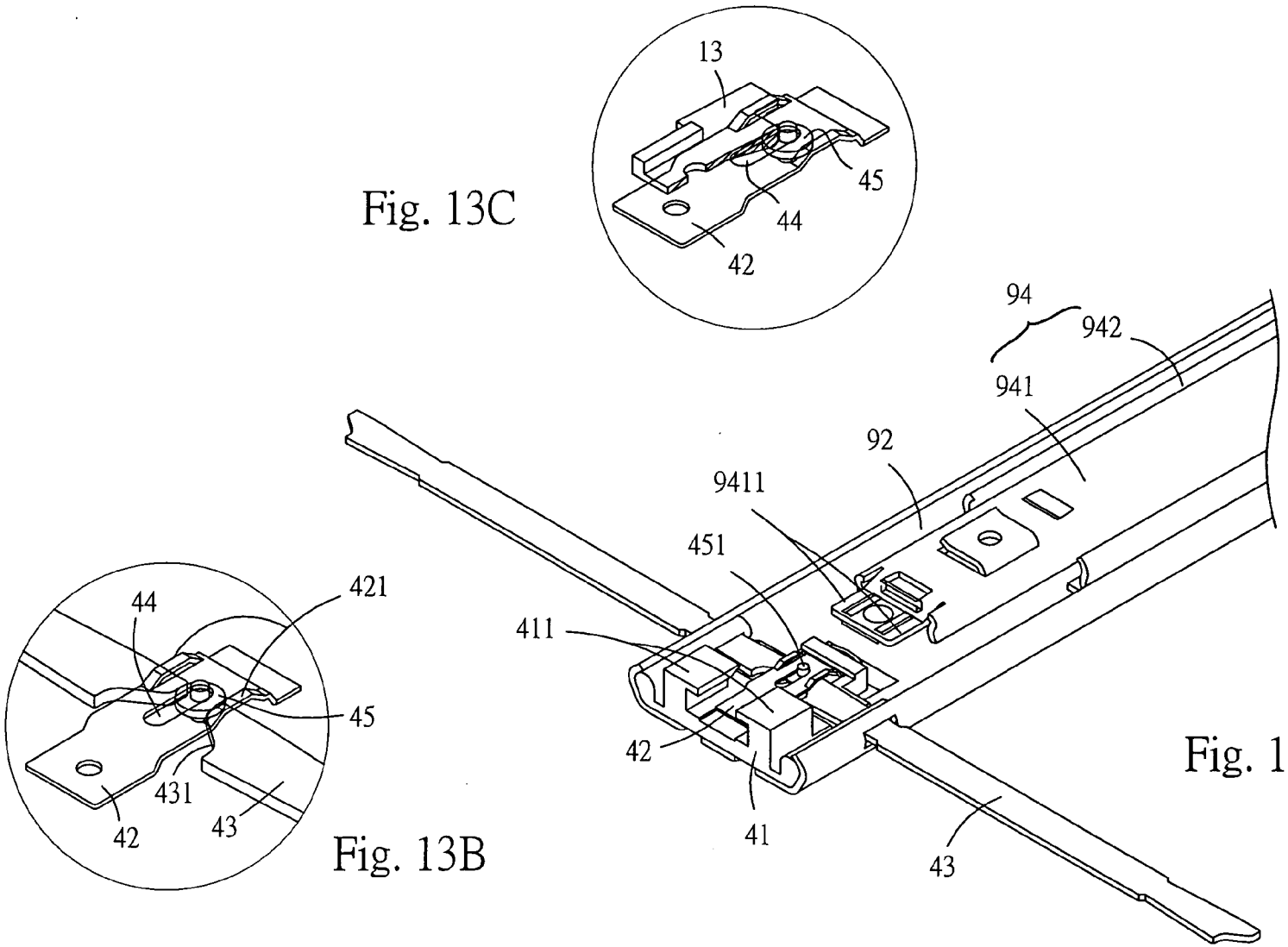
FIG. 13A is a perspective view of the third preferred embodiment of the present invention that the telescopic slide rail set is pulled out the stationary slide rail.
FIG. 13B is a perspective view showing that the slide member of FIG. 13A is in a second position.
FIG. 13C is a partial cutaway and perspective view showing that the slide member of FIG. 12A is dragged to the second position by a first activator.

Referring to FIGS. 6B and 6C, when the first connecting section 32 of the first activator 13 drags the third connecting section 451 to the second position, the other end of the first activator 13 is pushed and lifted by the guide face 421, whereby the first connecting section 32 releases the third connecting section 451, permitting the telescopic slide rail set 94 of the second slide rail assembly 12 to be further outward extended.

When the telescopic slide rail set 94 of the second slide rail assembly 12 is pushed into the stationary slide rail 92, the second connecting section 34 of the first activator 13 drags the third connecting section 451 to make the slide member 45 move from the second position to the first position. At this time, the fourth connecting section 452 of the slide member 45 is no more engaged with the bar member 43 and the telescopic slide rail set 94 of the first slide rail assembly 11 can be extended from the front end of the stationary slide rail 92.

According to the above arrangement, the assembled/linked locking apparatus 1 of the present invention has the following advantages:

1. The first and second connecting sections 32, 34 of the first activator 13 can drag the third connecting section 451 of the slide member 45, whereby the slide member 45 can be truly driven to drive the bar member 43.
2. The slide way 44 can restrict the slide member 45 from vertically moving. The slide member 45 can abut against the bar member 43. Therefore, the other drawer can be truly locked or released.

Please refer to FIG. 8, FIG. 9A, FIG. 9B, FIG. 10A and FIG. 10B, in the above structure, wherein the first activator 13 could be disposed at rear end of the drawer slide rail 941. As the second activator 14 is corresponding to the first activator 13, the second activator 14 is disposed at rear end of the stationary slide rail 92. This can achieve the same effect. In addition, the invention further includes a seventh connecting section 9411 and a eighth connecting section 411. The seventh connecting section 9411 is disposed at the rear end of the drawer slide rail 941. The eighth connecting section 411 is disposed at the base seat 41. When the telescopic slide rail set 94 is wholly pushed into the stationary slide rail 92, the seventh connecting section 9411 and the eighth connecting section 411 can mutually abut in order that the slide member 45 can really position at the first position. In case of unexpected external force, the function of the invention is ensured.

Please refer to FIG. 11, FIG. 12A, FIG. 12B, FIG. 12C, FIG. 13A, FIG. 13B and FIG. 13C of the first activator 13 being disposed at the rear end of the drawer slide rail 941, wherein the second connecting section 34 is formed with a lug disposed at the telescopic slide rail set 94. This can achieve the same effect as the above embodiment.

Alternatively, each telescopic slide rail set 94 can simply have the drawer slide rail 941 without the middle slide rail 942. Two sidewalls of the drawer slide rail 941 are slidably disposed in the stationary slide rail 92. This can achieve the same effect as the above embodiment.

The above embodiments are only used to illustrate the present invention, not intended to limit the scope thereof. Many modifications of the above embodiments can be made without departing from the spirit of the present invention.

What is claimed is:

1. A drawer locking apparatus disposed in a cabinet body having at least two vertically arranged drawers, when one of the drawers is drawn out, the other drawer being prevented from extending out of the cabinet body, said locking apparatus comprising:

a first and a second slide rail assemblies being respectively corresponding to each drawer, the first slide rail assembly being positioned above the second slide rail assembly corresponding to the second slide rail assembly, the first slide rail assembly and the second slide rail assembly respectively including a stationary slide rail and a telescopic slide rail set, the stationary slide rail being disposed on the cabinet body, the telescopic slide rail set being disposed on the drawer, the telescopic slide rail set being back and forth slidably disposed in the stationary slide rail, the telescopic slide rail set being extensible out of front end of the stationary slide rail;

a first and a second activators respectively being disposed on the first and second slide rail assemblies, the first activator being disposed at the telescopic slide rail set, the second activator being corresponding to the first activator and disposed at the stationary slide rail, the second activator including a base seat, a guide seat, a bar member, a pair of slide ways and a slide member, the base seat being disposed at the stationary slide rail, the guide seat being disposed on the base seat, the guide seat having a guide face for guiding the first activator to swing, the bar member being reciprocally movably disposed between the first and second slide rail assemblies, two ends of the bar member being respectively passed through spaces between the base seats and the guide seats of the first and second slide rail assemblies, the two slide ways being oppositely respectively formed on the base seat and the guide seat, the slide member being disposed between the base seats and the guide seats and corresponding to an end of the bar member, two ends of the slide member being respectively fitted through the slide ways, wherein the two ends of the slide member are slidable along the slide ways in the sliding direction of the telescopic slide rail set, one end of the slide member being dragged by the first activator and released by the swinging of the first activator, wherein the slide member is slidable back and forth between a first position and a second position, wherein when the slide member is positioned in the second position, the slide member abuts against the bar member, when the slide members of the first and second slide rail assemblies are positioned in the first position, means for making the bar member to move up and down and when one of the telescopic slide rail set is extended, the first activator drags the slide member from the first position to the second position, whereby the slide member pushes the bar member and then the slide member is engaged with the bar member to prevent the bar member from sliding.

2. The drawer locking apparatus as claimed in claim 1, wherein the first activator is disposed at rear end of the telescopic slide rail set.

3. The drawer locking apparatus as claimed in claim 2, wherein the telescopic slide rail set includes a drawer slide rail.

4. The drawer locking apparatus as claimed in claim 3, wherein:

the telescopic slide rail set further includes a middle slide rail being back and forth slidably disposed in the stationary slide rail; and the drawer slide rail is disposed on the corresponding drawer and slidably disposed in the middle slide rail.

5. The drawer locking apparatus as claimed in claim 1, wherein:

the first activator is formed with a first connecting section and a second connecting section corresponding to the slide member;

each slide way is a slot;

one side of the slide member is formed with a third connecting section corresponding to the first and second connecting sections, the first connecting section serving to connect with the third connecting section and drag the slide member from the first position to the second position, the second connecting section serving to connect with the third connecting section and drag the slide member from the second position to the first position;

a fourth connecting section is formed on the slide member, the bar member being formed with a fifth connecting section corresponding to the fourth connecting section, when the slide member is positioned in the first position, means for relatively displacing between the fourth and fifth connecting sections; and the bar member is further formed with a sixth connecting section corresponding to the fourth connecting section, when the slide member is positioned in the second position, the fourth connecting section and the sixth connecting section abutting against each other.

6. The drawer locking apparatus as claimed in claim 2, wherein:

the first activator is formed with a first connecting section and a second connecting section corresponding to the slide member;

each slide way is a slot;

one side of the slide member is formed with a third connecting section corresponding to the first and second connecting sections, the first connecting section serving to connect with the third connecting section and drag the slide member from the first position to the second position, the second connecting section serving to connect with the third connecting section and drag the slide member from the second position to the first position;

a fourth connecting section is formed on the slide member, the bar member being formed with a fifth connecting section corresponding to the fourth connecting section, when the slide member is positioned in the first position, means for relatively displacing between the fourth and fifth connecting sections; and the bar member is further formed with a sixth connecting section corresponding to the fourth connecting section, when the slide member is positioned in the second position, the fourth connecting section and the sixth connecting section abutting against each other.

7. The drawer locking apparatus as claimed in claim 3, wherein:

the first activator is formed with a first connecting section and a second connecting section corresponding to the slide member;

each slide way is a slot;

one side of the slide member is formed with a third connecting section corresponding to the first and second connecting sections, the first connecting section serving to connect with the third connecting section and drag the slide member from the first position to the second position, the second connecting section serving to connect with the third connecting section and drag the slide member from the second position to the first position;

a fourth connecting section is formed on the slide member, the bar member being formed with a fifth connecting section corresponding to the fourth connecting section, when the slide member is positioned in the first position, means for relatively displacing between the fourth and fifth connecting sections; and the bar member is further formed with a sixth connecting section corresponding to the fourth connecting section, when the slide member is positioned in the second position, the fourth connecting section and the sixth connecting section abutting against each other.

8. The drawer locking apparatus as claimed in claim 4, wherein:

the first activator is formed with a first connecting section and a second connecting section corresponding to the slide member;

each slide way is a slot;

one side of the slide member is formed with a third connecting section corresponding to the first and second connecting sections, the first connecting section serving to connect with the third connecting section and drag the slide member from the first position to the second position, the second connecting section serving to connect with the third connecting section and drag the slide member from the second position to the first position;

a fourth connecting section is formed on the slide member, the bar member being formed with a fifth connecting section corresponding to the fourth connecting section, when the slide member is positioned in the first position, means for relatively displacing between the fourth and fifth connecting sections; and the bar member is further formed with a sixth connecting section corresponding to the fourth connecting section, when the slide member is positioned in the second position, the fourth connecting section and the sixth connecting section abutting against each other.

9. The drawer locking apparatus as claimed in claim 5, wherein:

the first connecting section is a notch;

the second connecting section is a lug;

the third connecting section is a boss-shaped body;

the fourth connecting section is a partially lateral side of the slid member;

the fifth connecting section is a notch; and the sixth connecting section is a cross section.

10. The drawer locking apparatus as claimed in claim 6, wherein:

the first connecting section is a notch;

the second connecting section is a lug;

the third connecting section is a boss-shaped body;

the fourth connecting section is a partially lateral side of the slid member;

the fifth connecting section is a notch; and the sixth connecting section is a cross section.

11. The drawer locking apparatus as claimed in claim 7, wherein:

the first connecting section is a notch;

the second connecting section is a lug;

the third connecting section is a boss-shaped body;

the fourth connecting section is a partially lateral side of the slid member;

the fifth connecting section is a notch; and the sixth connecting section is a cross section.

12. The drawer locking apparatus as claimed in claim 8, wherein:

the first connecting section is a notch;

the second connecting section is a lug;

the third connecting section is a boss-shaped body;

the fourth connecting section is a partially lateral side of the slid member;

the fifth connecting section is a notch; and the sixth connecting section is a cross section.

13. The drawer locking apparatus as claimed in claim 6, further comprising a seventh connecting section and a eighth connecting section, the seventh connecting section being disposed at the rear end of the telescopic slide rail set, the eighth connecting section being disposed at the base seat, whereby when the telescopic slide rail set is wholly pushed into the stationary slide rail, the seventh connecting section and the eighth connecting section mutually abut in order that the slide member is positioned at the first position.

14. The drawer locking apparatus as claimed in claim 7, further comprising a seventh connecting section and a eighth connecting section, the seventh connecting section being disposed at the rear end of the drawer slide rail, the eighth connecting section being disposed at the base seat, whereby when the telescopic slide rail set is wholly pushed into the stationary slide rail, the seventh connecting section and the eighth connecting section mutually abut in order that the slide member is positioned at the first position.

15. The drawer locking apparatus as claimed in claim 8, further comprising a seventh connecting section and a eighth connecting section, the seventh connecting section being disposed at the rear end of the drawer slide rail, the eighth connecting section being disposed at the base seat, whereby when the telescopic slide rail set is wholly pushed into the stationary slide rail, the seventh connecting section and the eighth connecting section mutually abut in order that the slide member is positioned at the first position.

* * * * *